US005634496A

United States Patent [19]

Grabner, Jr.

[11] Patent Number: 5,634,496

[45] Date of Patent: Jun. 3, 1997

[54] COLLAPSIBLE TUBE

[75] Inventor: John N. Grabner, Jr., Lansdale, Pa.

[73] Assignee: Teledyne Industries, Inc., Chester, Pa.

[21] Appl. No.: 593,635

[22] Filed: Jan. 29, 1996

[51] Int. Cl.[6] ..... B65D 51/06

[52] U.S. Cl. ..... 138/89; 138/89.1; 215/305

[58] Field of Search ..... 138/89, 89.1–89.4; 215/209, 223, 305, 295

[56] References Cited

U.S. PATENT DOCUMENTS 5,397,008 3/1995 Glynn ..... 215/223 X

OTHER PUBLICATIONS

UK Patent Application 2256638 Bernard Dominic Noel Cooke Dec. 1992.

*Primary Examiner*—David Scherbel
*Assistant Examiner*—Patrick F. Brinson
*Attorney, Agent, or Firm*—Eugene Chovanes

[57] ABSTRACT

The invention is an improved cap for a collapsible tube, particularly a tube having tamper evident means as is used on tubes having eye medications. The cap has a flexible substantially cylindrical wall which can be squeezed into an elliptical shape to permit the user to exert substantial force, by means of a "thumb screw" effect, to unscrew the cap from the tube.

11 Claims, 3 Drawing Sheets

COLLAPSIBLE TUBE

BACKGROUND OF THE INVENTION

1. Field of the Invention

The invention pertains to the field of collapsible tubes and more particularly to caps for such tubes. The invention is particularly useful for collapsible tubes of the type used for eye medications having an eye tip, the tubes having therein a form of tamper evident means that disclose any prior opening of the tube.

2. Description of the Related Art

The Art

In U.S. Pat. No. 3,731,849 issued May 8, 1973, for Container and Cap Combination To Indicate Tampering, there is shown a collapsible tube of the type having a collapsible body and a rigid shoulder which terminates in a tapered nozzle having an orifice in the end. The nozzle has on the outside thereof in the area of the shoulder a threaded boss which receives thereon a cap. The cap has a tapered hollow post which generally conforms to the tapered nozzle. Such cap design is necessary for efficient closure of the orifice when the cap is screwed on the tube. Such collapsible tube design is particularly used for eye medications wherein the nozzle having an orifice at the end thereof permits the medicine to be accurately deposited in the eye.

To show tampering with the contents of the tube, the '849 patent discloses an arrangement wherein a flange is formed on the tube above the tube shoulder, and a flexible skirt formed integrally on the cap is initially positioned under the flange. When the cap is initially unscrewed from the tube, the skirt flexes under the rotational and longitudinal forces imparted to the cap and escapes from beneath the flange. Any effort to rescrew the cap and reposition the skirt below the flange is thwarted by the outward flair of the skirt. Upon rescrewing it is then evident that the cap has previously been initially removed, since it must rest above the flange. The arrangement described above as disclosed in the '849 patent works well to indicate tampering.

The Problem

Except when there has been tampering, the user must be the one to initially remove the cap when the skirt is beneath the flange. The user must exert a substantial rotational force to initially unscrew the cap and flex or deform the skirt from beneath the flange, since the skirt resists such flexing or deformation. It is difficult for the user with the prior art cap, to exert such substantial force.

The difficulties occur because of the prior art cap design. The relatively short base of the cap is difficult to grasp with the fingers for rotation, since it is relatively short. The user also attempts to grasp the post of the cap, which is tapered and smooth and which conforms to the nozzle of the tube. This post design encourages the fingers to slide away from the base and away from the cap. In effect, the harder a person tries to grasp the base with the fingers, to initially unscrew the cap, the more the fingers want to slide away from the base of the cap. Even the ridges on the base help little. This makes it extremely difficult to initially unscrew the cap and flex or deform the flexible skirt thereon from underneath the flange.

SUMMARY OF THE INVENTION

In the present invention, a hollow flexible substantially cylindrical wall extends integrally from the base and around the post of a prior art cap. The present invention permits the fingers to get a firm grip on the entire cap, and temporarily deform the substantially cylindrical wall of the cap to a "thumb screw" position. There is no tendency, as in the prior art, for the fingers to slide away from the cap on the tapered post portion of the cap. The outside of the cap is ridged throughout its length, which includes the base and the hollow substantially cylindrical wall. The cap retains the tapered post which is necessary to conform to the tapered nozzle, since there is a sealing and wiping effect which must occur when the cap is replaced on the nozzle in this particular type of collapsible tube.

In the invention, one may now grasp the cap, which is initially circular in cross-section, and squeeze and deform the substantially cylindrical wall of the cap into a relatively flat ellipse which permits such "thumb screw" type of effect to be placed on the cap. Thus, a user, by simply squeezing and distorting the cap into an ellipse or flattened oval condition, along with having a substantial grip on the cap by reason of its extended length longitudinally, may simply but effectively exert a substantial rotational or torque force to unscrew the cap. This forces the skirt under the flange to flex or deform and escape from beneath the flange.

The ellipse that is created by squeezing has an inner limit which is defined or created by the tapered, radially inward post of the cap which is relatively stiff. Thus, not only is the user now enabled to grasp a greater portion of the cap, and flatten the cap in to an oval shape to permit greater torque and leverage, but the user has the added benefit of squeezing the flexible hollow substantially cylindrical wall of the cap up against the relatively stiff inner portion in the form of a tapered post. This gives the user a firm grasp on the entire cap and a position which is reached providing a force is exerted in squeezing the flexible portion together. Thus, a defined ellipse is created in each use of the cap which is an advantageous one for removing the cap.

Upon release of the fingers' pressure the cap returns to its initial circular cross-sectional shape. In effect the cap has a memory.

Although the cap of the invention is disclosed herewith in use on a tamper evident collapsible tube, it should be understood the cap can be used without such feature on the tube, since the increased rotational force effect does not depend on the tamper evident feature.

BRIEF DESCRIPTION OF THE DRAWINGS

FIG. 1 represents prior art.

FIG. 7 also shows the outer and inner limit positions of the wall deflection. The outer limit shown in dot and dash line.

DESCRIPTION OF THE PREFERRED EMBODIMENT

Figure 1:
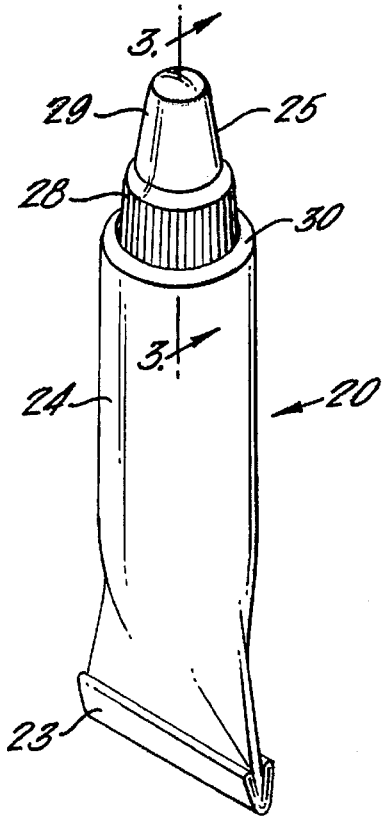
Fig. 1. (PRIOR ART)
FIG. 1 is a slightly enlarged isometric view of a typical collapsible metal tube having a tamper evident closure. The collapsible metal tube and closure shown is used primarily for the storing and dispensing of a medicant particularly for eyes.

The cap of the invention will be disclosed in detail relative to a prior art tamper evident eye tip collapsible tube and cap.

The Prior Art

Such a prior art collapsible tube and cap is seen in in FIGS. 1, 3, 9 and 10. These are used often for opthalmic eye ointments. A typical prior art tube 20 has a dimension of ½" in diameter and 2¾" long. The tube has a suitable tapered tip or nozzle 21 at one end and a folded closure 23 at the other end. The nozzle 21 has an orifice 22 at the end through which the contents are dispensed by squeezing tube body 24.

A prior art one-piece cap 25 generally conforming to the nozzle 21 is screwed over the nozzle 21 on a threaded boss 26 formed at the base of nozzle 21 which is an integral part of the tube 20.

Prior art cap 25, formed in one-piece, as by molding, of plastic, has a base 28 and a tapered post 29.

The tamper evident means are used to indicate any tampering with respect to the tube contents prior to an initial opening by a user. In the prior art, a skirt 27 was formed on the base 28 of the prior art cap 25 and a flange 30 extended above and from the shoulder 31 of the tube body 24. During the manufacturing of the tube, the prior art cap 25 is threaded on to boss 26, and then flange 30, which is an integral extension of shoulder 31, is spun over the flange 27 of the prior art cap 25 to capture the skirt 27 beneath the flange 30. The tube 20 remains open at the bottom for the subsequent filling and sealing operation after which closure 23 is formed. This prior art concept is shown in U.S. Pat. No. 3,731,849 for Container and Cap Combination to Indicate Tampering as referred to earlier, and incorporated herein by reference.

Figure 5:
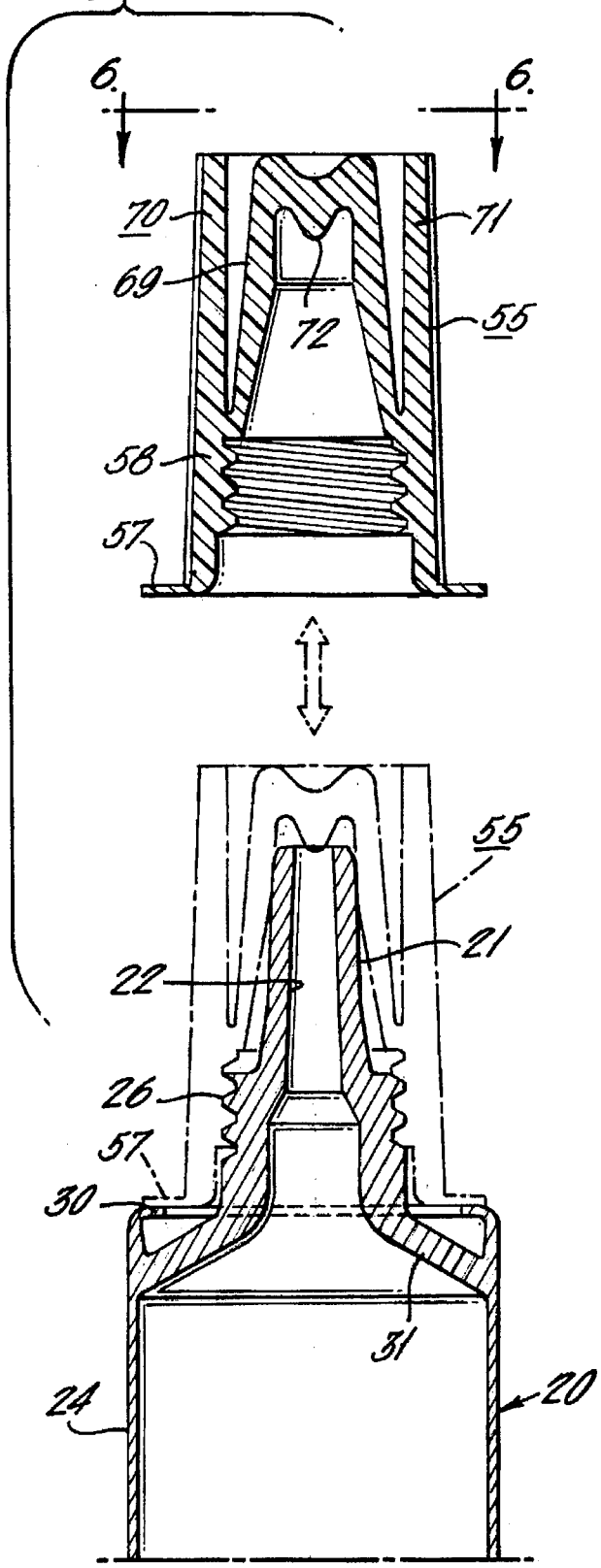
FIG. 5 is an exploded sectional view of a fragment of the dispensing nozzle end of the collapsible metal tube and the cap of the invention as removed from the nozzle end of the tube, all shown in full lines. Also shown, in dot and dash lines, is the replacement of the cap of the invention on the tube nozzle, illustrating the tamper evident feature.

The construction shown in the '849 patent has been successful in showing evidence of any prior opening of the tube 20. When the cap 25 is unscrewed from the threaded boss 26, the flexible skirt 27 on the cap 25 flexes and escapes from beneath the flange 30 as set forth in the '849 patent. Also, the flange 30 can permissibly be somewhat deformed during this operation. When the prior art cap 25 is rescrewed on the tube 20 to a closed position after having once been removed, the skirt 27 no longer can fit underneath the flange 30 but rests above the flange as shown in FIG. 5 so that it is clear to an observer that the cap 25 has at least once been removed from the tube after filling.

The Problem in the Prior Art

Figure 9:
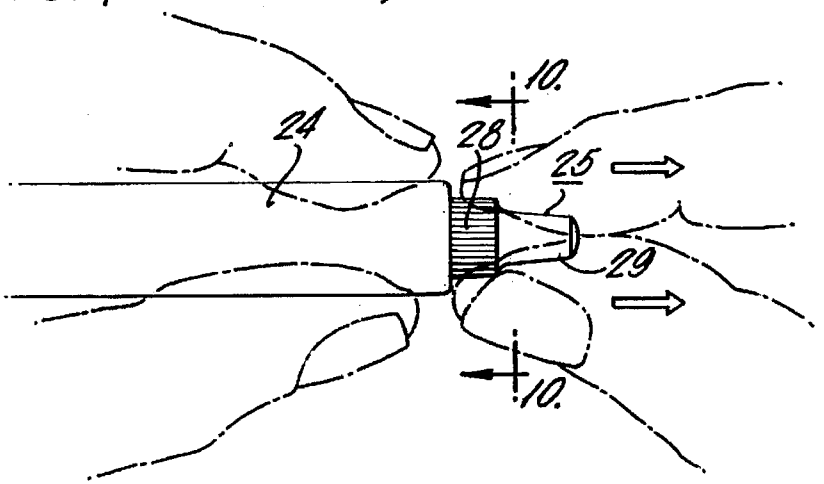
FIG. 9. (PRIOR ART)
FIG. 9 is a schematic plan view illustrating the collapsible metal tube, such as shown in FIG. 1 and labeled prior art, firmly held by the thumb and second finger of the left hand, and it's cap, held by the thumb and second finger of the right hand in a position to unscrew the cap from the collapsible metal tube. The fragmentary fingers are shown in a dot and dash line.

In the prior art, there has been difficulty in removing the prior art cap 25 from the tube 20 the first time after the filling. During this initial removal, the skirt 27 must be flexed and bent and rotated in frictional engagement with the underside of the flange 30. Also, the skirt 27 must be bent into a position wherein its diameter is less than that inside the diameter of the flange 30. As seen in FIG. 9, this can be difficult for all of the reasons stated above.

Figure 10:
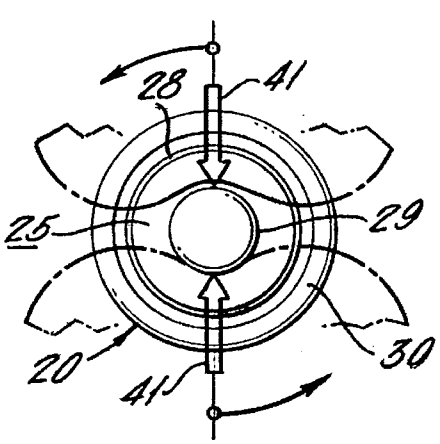
FIG. 10. (PRIOR ART)
FIG. 10 is an enlarged view of the tube and cap such as shown in FIG. 1 and labeled prior art taken on the line 10,10 of FIG. 9 showing in dot and dash line fragments of the second finger and thumb of the right hand positioned on the cap and applying an opposed force on the cap while rotating the cap in a counterclockwise direction to remove the cap from the tube.

With particular reference to the prior art as seen in FIG. 9 and 10, generally the thumb and finger of one hand grasp the prior art cap 25, and the other hand holds the tube body 23. In spite of the user's best efforts, the fingers on the prior art cap 25 tend to slip and move away from the prior art cap 25 in the direction shown by the arrows. The fingers gain little advantage from the longitudinally ridged portion 28 of the cap 25. The portion of the fingers that overlies the tapered post 29 of the cap do not help in applying a torque and effecting removal, but in fact slide both rotationally and longitudinally in the direction of the arrows 40, notwithstanding application of force in the direction 41 as seen in FIG. 10.

The Present Invention

Figure 2:
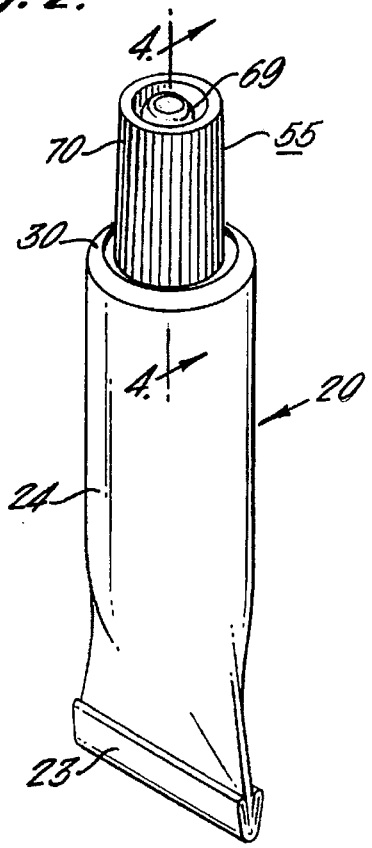
FIG. 2 is an isometric view similar to FIG. 1 showing the cap of the invention on the prior art collapsible metal tube having a tamper evident closure.
Figure 3:
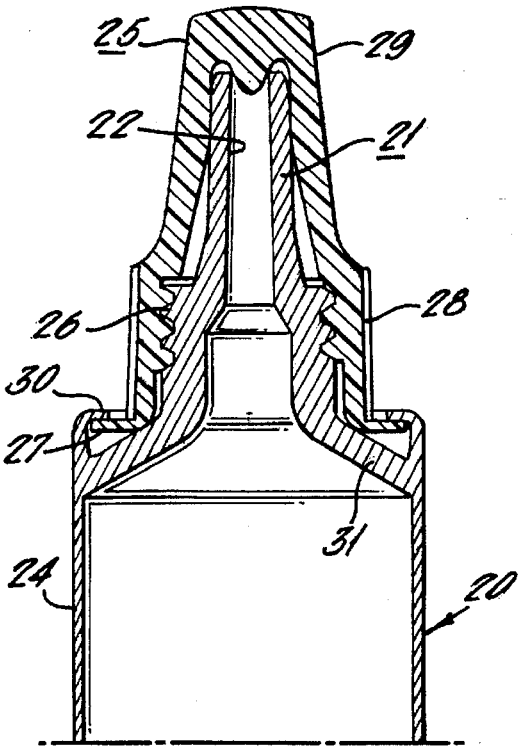
Fig. 3. (PRIOR ART)
FIG. 3 is an enlarged fragmentary sectional view taken on the line 3,3 of FIG. 1 and designated prior art, showing details of the dispensing nozzle end of the collapsible metal tube and the cap, prior to an initial opening.
Figure 4:
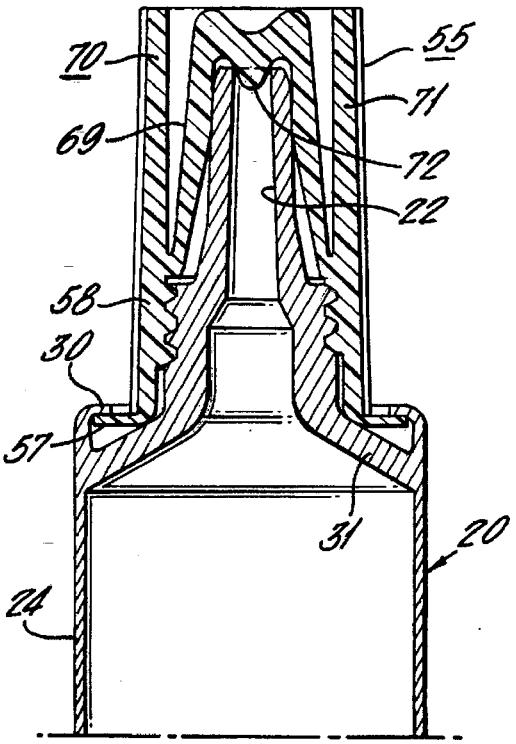
FIG. 4 is an enlarged fragmentary sectional view taken on the line 4,4 of FIG. 2 showing the cap of the invention on the prior art collapsible tube.

As seen in FIG. 2 and 4, the tube 20 remains the same as in the prior art. Hence, the same reference numerals previously used apply.

New cap 55 has a skirt 57 formed on the base 58 of the cap 55 as in the prior art. Again, the flange 30 is formed over skirt 57 as in the prior art. The new cap 55 has incorporated therein all the beneficial features of the old cap 25 relative to the tamper evident feature. However, the improvement is directed to the ease with which the cap can be initially removed from the tube.

In the present invention, a flexible substantially cylindrical member 70 is integrally formed with base 58 on cap 55. Substantially cylindrical member 70 can be somewhat tapered, as seen in the drawings. In effect, member 70 can be slightly cone shaped, with a slightly decreasing cross section in a direction longitudinally away from the base. Member 70 should not be tapered, however, to the degree that it would cause the fingers to slide away from the base, or interfere with flexibility. Member 70 is hollow and extends around rigid smooth post 69, which, as did post 29 in prior art cap 25, conforms to the shape of the tapered nozzle 21. Member 70 is formed of a relatively thin wall 71 so that the wall 71 can be deformed by finger pressure. The member 70 extends longitudinally from base 58 to around the end of rigid post 69. Wall 71 may be suitably reinforced, as by integral ribs, providing the wall remains flexible.

The entire cap 55 can be suitably made by injection molding of a thermoplastic material such as polyethylene or polypropylene. The relative rigidity or flexibility is created by the material and the design illustrated.

Base 58 and wall 71 have continuous longitudinally extending ridges on their outer surface to permit a firm grasp to avoid slippage.

In a totally closed position for filling and subsequent closing or sealing, a nozzle ceiling bead 72 of the cap 55 seats in nozzle orifice 22, as in the prior art.

Figure 6:
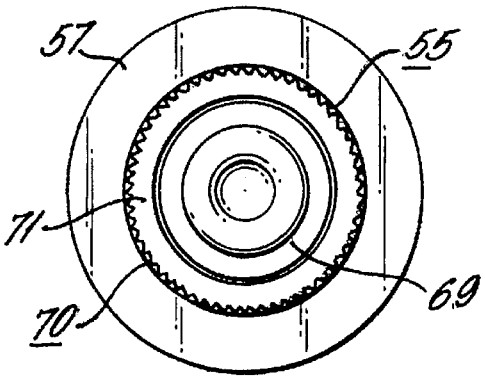
FIG. 6 is a plan view of the cap of the invention taken on the line 6,6 of FIG. 5.
Figure 12:
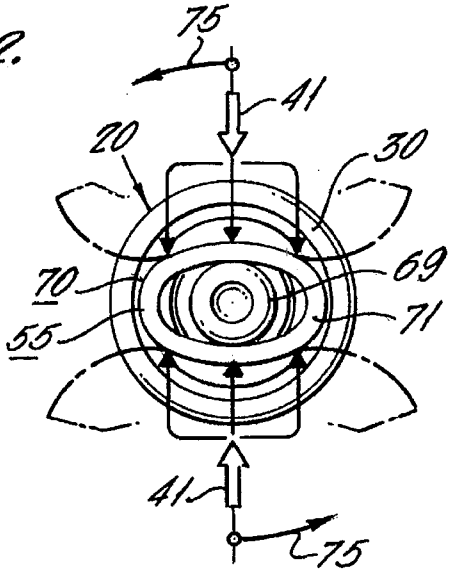
FIG. 12 is an enlarged end view of the tube and cap of the invention taken on the line 12,12 of FIG. 11 showing in dot and dash line fragments of the second finger and thumb exerting opposed forces on the resilient wall of the cap of the invention while rotating the cap in a counterclockwise direction to remove the cap from the tube.
Figure 11:
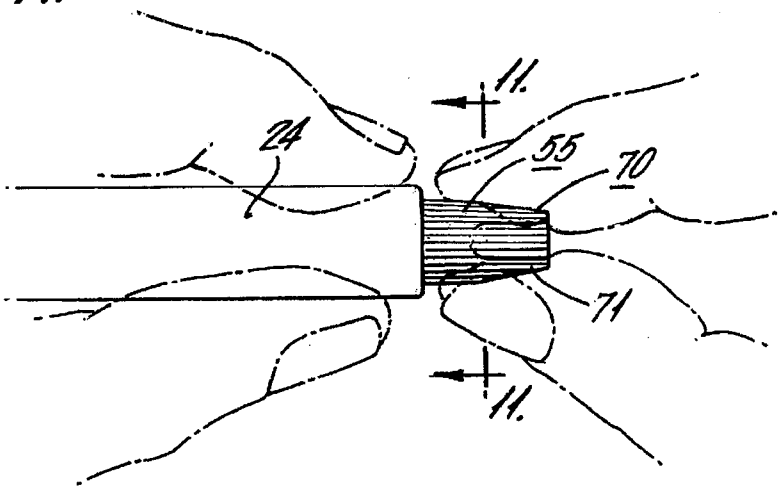
FIG. 11 is a schematic plan view similar to FIG. 9 but showing the collapsible metal tube fitted with the cap of the invention such as shown in FIG. 2.

In operation, a user grasps the cap 55 as seen in FIGS. 11 and 12, and applies a squeezing force wall 71 on the cap. The wall 71 naturally deforms as seen particularly in FIGS. 7, 8 and 12. The wall 71 flattens from a circular crossed section as seen in FIG. 6, to an oval shape as seen in FIGS. 8 and 12.

Wall 71 will return to the initial shape of member 70 when the forces from the fingers are removed.

Figure 8:
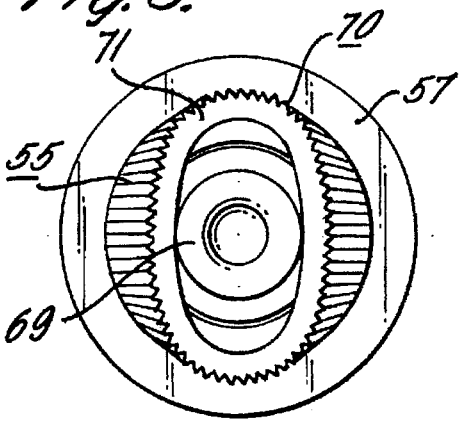
FIG. 8 is a plan view of the cap of the invention taken on the line 8,8 of FIG. 7 showing the elliptical shape taken by the circumferentially extending wall when subjected to the opposing forces shown in FIG. 7.
Figure 7:
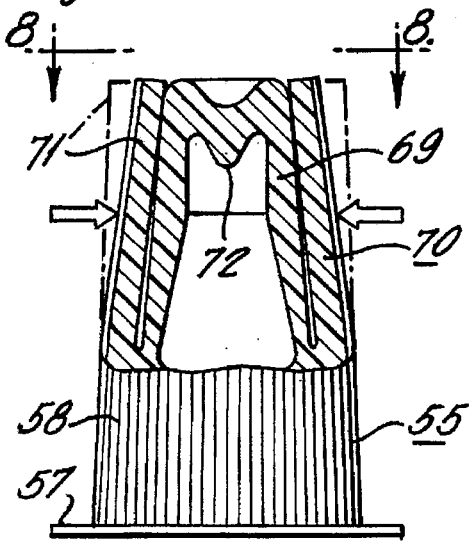
FIG. 7 is an elevational view of the cap of the invention with a portion broken away and in section clearly showing the inward deflection of the circumferentially extending substantially cylindrical wall when opposing forces are applied in the direction of the arrows.

Wall 71 flattens against post 69 as particularly shown in FIGS. 7, 8 and 12. This permits not only a firm grasp, but creates a "thumb-screw" effect wherein an increased leverage or torque is created by extending the lever arm or diameter at which the force can be applied, as shown in FIG. 12. The force to unscrew cap 55 is applied by the fingers to effect removal by rotation in the direction shown by arrows 75.

In FIG. 5, the new cap 55 is shown in solid lines removed from tube 20. When the cap 55 is rescrewed on the tube 20, the cap 55 seats on the tube 20 as shown in dot and dash lines, giving evidence of its prior removal.

What is claimed is:

1. In a one-piece cap for a collapsible tube having:

a) a rigid post extending longitudinally from a rigid base, b) the post being smaller in cross section than the base; the improvement comprising a continuous, hollow, flexible, substantially cylindrical, wall extending longitudinally from the base and around the post for substantially the length of the post, wherein the wall can be deformed by squeezing into an elliptical cross section about the post.

2. A cap of claim 1, wherein the exterior of the base and cylindrical wall have ridges thereon.

3. A cap of claim 1, wherein the substantially cylindrical wall has a slight tapered, cone shape.

4. The cap of claim 1 wherein the wall can be squeezed against the post, whereby the deformation of the wall is limited.

5. The cap of claim 1 or 4 wherein the wall returns to its original shape when the wall is no longer squeezed.

6. The cap of claim 1 or 4 wherein the cap is formed of a thermoplastic having a memory.

7. A one-piece cap for a collapsible tube comprising a) a rigid base, b) a rigid post extending longitudinally from said rigid base, c) a flexible substantially cylindrical wall extending from the base and around the post, and d) a flexible skirt extending from the base;

in combination with a collapsible tube having:

a) a shoulder, and b) a flange extending inwardly from the shoulder, wherein a) the skirt of the cap initially is in a position beneath the flange, and b) a user initially removes the cap from the tube and the skirt from beneath the flange by squeezing the cylindrical wall into an ellipse shape around the post, whereby the user can exert a rotational force on the cap.

8. The combination of claim 7, wherein the wall is slightly tapered into a cone shape.

9. The combination of claim 7 wherein the user squeezes the cap against the post.

10. The combination of claim 7 wherein the wall returns to its original shape when the wall is no longer squeezed.

11. The combination of claim 7 wherein the cap is formed of a thermoplastic having a memory.

* * * * *